US007217141B2

(12) United States Patent
Linssen et al.

(10) Patent No.: US 7,217,141 B2
(45) Date of Patent: May 15, 2007

(54) CONNECTION CARRIER AND METHOD FOR JOINING THE CONNECTION CARRIER TO AN INJECTION-MOLDED PART

(75) Inventors: Mathias Linssen, Litzendorf (DE); Christof Vogel, Bischberg (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 11/256,140

(22) Filed: Oct. 21, 2005

(65) Prior Publication Data

US 2006/0035490 A1 Feb. 16, 2006

Related U.S. Application Data

(62) Division of application No. 10/070,142, filed as application No. PCT/DE01/02412 on Jul. 4, 2001.

(30) Foreign Application Priority Data

Jul. 4, 2000 (DE) ..... 100 32 337

(51) Int. Cl.
*H01R 12/00* (2006.01)

(52) U.S. Cl. ..... 439/75

(58) Field of Classification Search ..... 439/75, 439/500, 44–48; 174/267, 260; 248/217.2, 248/304, 217.3, 218.1
See application file for complete search history.

(56) References Cited

U.S. PATENT DOCUMENTS

| | | | | |
|---|---|---|---|---|
| 3,533,054 | A | 10/1970 | Spriggs et al. | |
| 5,046,857 | A | 9/1991 | Metzger et al. | |
| 5,908,328 | A | 6/1999 | Chen | |
| 6,353,191 | B1 | 3/2002 | Harper | |
| 6,474,608 | B1 * | 11/2002 | Takata | 248/217.2 |
| 2004/0159979 | A1 * | 8/2004 | Tanaka | 264/328.1 |
| 2004/0224050 | A1 * | 11/2004 | Hechtl | 425/554 |

FOREIGN PATENT DOCUMENTS

| | | | |
|---|---|---|---|
| DE | 2838634 | * | 9/1978 |
| DE | 43 32 172 | | 3/1995 |
| DE | 295 14 315 U | | 11/1995 |
| WO | WO 95/22154 | | 8/1995 |

* cited by examiner

*Primary Examiner*—Jean F. Duverne
(74) *Attorney, Agent, or Firm*—Kenyon & Kenyon LLP

(57) ABSTRACT

A connection carrier, e.g., a connection carrier for the bobbins of solenoids, includes a positioning section for positioning the connection carrier in a recess of an injection-molded part surrounding the connection carrier and includes a locking section projecting over the width of the positioning section for anchoring the connection carrier in the injection-molded part.

1 Claim, 1 Drawing Sheet

CONNECTION CARRIER AND METHOD FOR JOINING THE CONNECTION CARRIER TO AN INJECTION-MOLDED PART

CROSS-REFERENCE TO RELATED APPLICATIONS

This application is a division of U.S. patent application Ser. No. 10/070,142, filed Jul. 16, 2002, which was the National Stage of PCT International Application No. PCT/DE01/02412, filed Jul. 4, 2001, each of which is expressly incorporated herein in its entirety by reference thereto.

FIELD OF THE INVENTION

The present invention relates to a connection carrier and a method for joining the connection carrier to an injection-molded part.

BACKGROUND OF THE INVENTION

A connection carrier according to the definition of the species is known, for example, from German Published Patent Application No. 43 32 172 and, especially for solenoids, from German Patent No. 295 14 315.

The embedding of metallic connection carriers into an injection-molded part, in particular into the bobbin of a solenoid, which is used, for example, in (high-pressure) fuel injectors, usually occurs during production of the injection-molded part. In doing this, the connection carrier is positioned at the correct location in the injection mold, and the injection-molded part is then produced in the mold. This embeds the connection carrier into the injection-molded part.

The disadvantage of the method described above relates, in particular, in its high production costs, since the necessary tools must be sealed against the injection pressure, thus increasing the tool costs.

In addition, it is not possible to position the connection carrier in the injection-molded part with a sufficient degree of accuracy, and the connection carrier can additionally shift position or rotate during later processing steps if the plastic has not yet been fully cured.

Due to the shape of commonly used connection carriers, it is also not possible to prevent the connection carrier from slipping out of the injection-molded part after curing, since no locking elements are provided to hold the connection carrier in place under tensile load.

SUMMARY

The connection carrier according to the present invention, and the method according to the present invention for joining the connection carrier to an injection-molded part, provide a connection carrier that is joined to the injection-molded part so that it is precisely and immovably anchored in a defined location.

The connection carrier may be injected into the finished injection-molded part with little engineering effort, while achieving high positioning accuracy, since the plastic has already been largely cured, and the position of the injected connection carrier is therefore no longer variable.

The present invention may provide a simple shape of the connection carrier, which may be punched out of a metal sheet in the conventional manner, along with the anchoring elements.

The configuration of the anchoring elements is freely selectable, including a saw-tooth shape as well as, for example, an angular or rounded shape.

The area of the injection-molded part where the connection carrier is injected may be preformed by slightly modifying existing injection molds.

DETAILED DESCRIPTION

Figure 1:
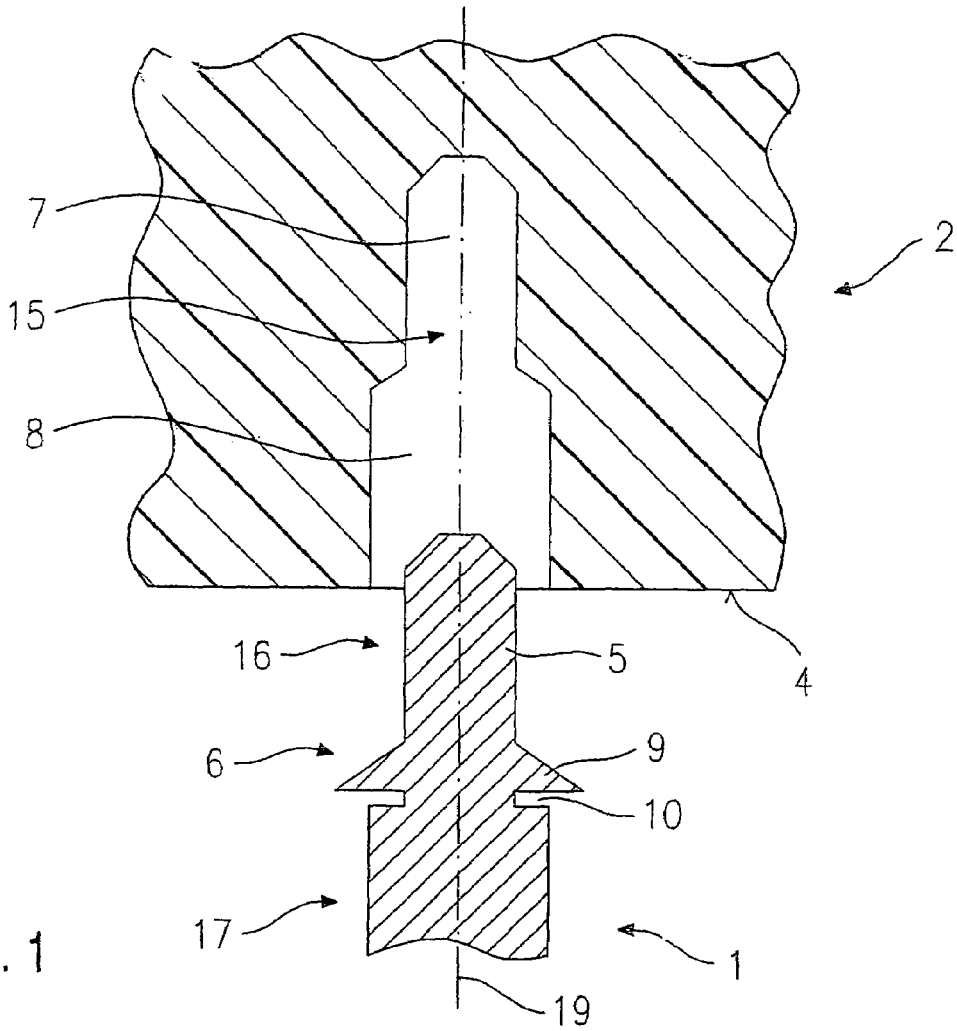
FIG. 1 is a schematic longitudinal cross-sectional view of a connection carrier according to the present invention and the correspondingly shaped injection area of an injection-molded part.

FIG. 1 illustrates an extract of a schematic cross-sectional representation of a first example embodiment of a connection carrier 1 according to the present invention. Connection carrier 1 is used, in particular, in fuel injectors, where it establishes the connection between a solenoid wound onto a bobbin and an electronic control unit for operating the fuel injector. The bobbin is produced by injection molding.

Connection carrier 1 may have a flat shape and may be produced by punching it from a metal sheet. The carrier may have fastening holes 13 and recesses 18 in a bending area 14 (FIG. 2) that enable connection carrier 1 to be further processed after it has been inserted into an injection-molded part 2, such as a bobbin.

In the example embodiment, connection carrier 1 has a tab-shaped positioning section 5, which forms a first end 16 of connection carrier 1. Positioning section 5 may be configured with a round or polygonal shape. Positioning section 5 of connection carrier 1 ensures the precise positioning of connection carrier 1 in injection-molded part 2.

Figure 2:
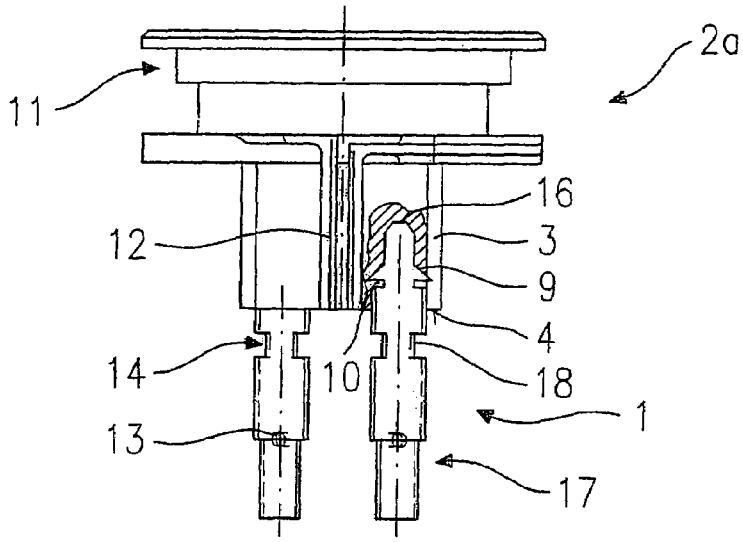
FIG. 2 is a schematic view of a bobbin for a solenoid, having two connection carriers configured according to the present invention.

Positioning section 5 of connection carrier 1 is followed by a locking section 6. The latter helps securely anchor connection carrier 1 in injection-molded part 2. In the example embodiment, locking section 6 of connection carrier 1 is configured in the form of two projections 9, which have a saw-toothed shape. Projections 9 are offset against a second end 17 of connection carrier 1 by recesses 10. The purpose of recesses 10 is to absorb any forming energy that occurs while connection carrier 1 is being inserted into injection-molded part 2, thus preventing connection carrier 1 from bending in bending area 14. As illustrated in FIG. 2, second end 17 of connection carrier 1 may have fastening holes 13 and recesses 18 in bending area 14 for fasting the wire ends of the solenoid and to facilitate further processing.

Injection-molded part 2 has a corresponding recess 15 into which connection carrier 1 is inserted. Recess 15 is divided into a positioning area 7 and a locking area 8. Positioning area 7 is shaped so that positioning section 5 of connection carrier 1 fits snugly when inserted. Locking area 8 of recess 15 has a width perpendicular to a longitudinal axis 19 of connection carrier 1 that is equal to the width of second end 17 of connection carrier 1. However, projections 9 of connection carrier 1, which anchor connection carrier 1 in injection-molded part 2, are larger in width. As a result, connection carrier 1 is securely anchored in injection-molded part 2, since projections 9 dig into the plastic of injection-molded part 2. Inserting connection carrier 1 into injection-molded part 2 also causes a slight deformation of projections 9, bending them like hooks away from the direction of insertion after connection carrier 1 has been inserted into injection-molded part 2.

Connection carrier 1 is inserted into injection-molded part 2 by injecting it shortly before the plastic of injection-molded part 2 has completely cured. Injection may be performed, for example, using compressed air. Connection carrier 1 is anchored in injection-molded part 2 by barb-like projections 9 so that it is no longer possible to withdraw connection carrier 1 from recess 15 in injection-molded part 2 even after the plastic of injection-molded part 2 has completely cured. The deformation of projections 9 produced during injection causes them to spread further.

Briefly heating the plastic of injection-molded part 2 once again during additional processing steps, for example when soldering the wire ends of the solenoid to connection carrier 1, increases the form fit between injection-molded part 2 and connection carrier 1 in locking area 8 without affecting the position of connection carrier 1 in injection-molded part 2.

This effect may be further enhanced by increasing the mounting length and/or increasing the injection depth of connection carrier 1 in injection-molded part 2, since the positioning and locking functions may be spaced far apart from each other.

FIG. 2 illustrates a schematic representation of an example embodiment of connection carrier 1 according to the present invention. Injection-molded part 2 in this example embodiment is configured as a bobbin 2*a* which holds windings of a solenoid for operating a fuel injector.

Bobbin 2*a* has a winding area 11 that accepts the solenoid windings in a further processing step. The ends of the winding are routed to connection carrier 1 through wire guides 12 over an extension 3 of bobbin 2*a*.

Connection carriers 1 are provided at one end 4 of extension 3. Connection carriers 1 have fastening holes 13 for the solenoid wire ends as well as a bending area 14 in which connection carriers 1 may be bent during additional processing steps. As demonstrated for right connection carrier 1 in FIG. 2, first end 16 of connection carriers 1 may have the configuration illustrated in greater detail in FIG. 1 and may be inserted into bobbin 2*a* according to the method described above for joining connection carrier 1 to injection-molded part 2.

The present invention is not limited to the illustrated example embodiment, but is also suitable for connection carriers 1 having a great many other shapes. The method according to the present invention may be used for inserting any metal parts into a preformed injection-molded part.

What is claimed is:

1. A method for joining a connection carrier to an injection-molded part, the connection carrier including a positioning section configured to position the connection carrier in a recess of the injection-molded part surrounding the connection carrier and a locking section projecting over a width of the positioning section configured to anchor the connection carrier in the injection-molded part, comprising the steps of:

punching out the connection carrier;

preforming the injection-molded part to fit a shape of the connection carrier; and injecting the connection carrier into the injection-molded part, wherein the injection-molded part includes a positioning area and a locking area and the connection carrier is injected in the injecting step so that the positioning section of the connection carrier fits snugly when inserted into the positioning area of the injection-molded part, and the locking section of the connection carrier projecting over the width of the positioning section is locked in place in the locking area of the injection-molded part.

* * * * *